US007552842B1

(12) United States Patent
Carvajal

(10) Patent No.: US 7,552,842 B1
(45) Date of Patent: Jun. 30, 2009

(54) TRASH BAG DISPENSER

(76) Inventor: Gustavo Carvajal, 522 W. 157th St., New York, NY (US) 10032

( * ) Notice: Subject to any disclaimer, the term of this patent is extended or adjusted under 35 U.S.C. 154(b) by 679 days.

(21) Appl. No.: 11/159,676

(22) Filed: Jun. 23, 2005

(51) Int. Cl.
*G07F 11/72* (2006.01)
*B65H 5/28* (2006.01)
*B26F 3/02* (2006.01)

(52) U.S. Cl. ..... 221/30; 221/70; 225/106

(58) Field of Classification Search ..... 221/30, 221/31, 32, 45, 46, 102, 70; 225/106
See application file for complete search history.

(56) References Cited

U.S. PATENT DOCUMENTS

| | | | | | |
|---|---|---|---|---|---|
| 1,764,081 | A * | 6/1930 | Jones et al. | ..... | 53/77 |
| 2,349,635 | A * | 5/1944 | Pusheck | ..... | 225/85 |
| 3,181,089 | A * | 4/1965 | Kazuhiro | ..... | 333/28 R |
| 3,510,034 | A * | 5/1970 | Burke et al. | ..... | 225/77 |
| 3,800,503 | A * | 4/1974 | Maki | ..... | 53/390 |
| 4,714,191 | A * | 12/1987 | Richardson | ..... | 229/121 |
| 5,558,262 | A * | 9/1996 | Simhaee | ..... | 225/106 |
| 5,573,168 | A * | 11/1996 | Kannankeril et al. | ..... | 225/106 |
| 5,704,511 | A | 1/1998 | Kellams | | |
| 5,706,993 | A * | 1/1998 | DeMatteis | ..... | 225/106 |
| 6,178,725 | B1 * | 1/2001 | Sperry et al. | ..... | 53/451 |
| 6,199,788 | B1 * | 3/2001 | Simhaee | ..... | 242/422.5 |
| 6,235,369 | B1 * | 5/2001 | Shepard et al. | ..... | 428/85 |
| 6,283,001 | B1 * | 9/2001 | Schultes | ..... | 83/39 |
| 2005/0127083 | A1 * | 6/2005 | Russell | ..... | 221/30 |
| 2005/0162501 | A1 * | 7/2005 | Seo et al. | ..... | 347/157 |

* cited by examiner

*Primary Examiner*—Patrick Mackey
*Assistant Examiner*—Michael E. Butler
(74) *Attorney, Agent, or Firm*—Crossley Patent Law; Mark A. Crossley

(57) ABSTRACT

A trash bag dispenser for use with a roll of trash bag material, comprising a parallelepiped frame having a back, two spaced apart sides, and a bottom, a v-notch in a top of each side for removably receiving a support rod holding a roll of trash bag material, a horizontal support shelf disposed below the v-notches for supporting material unrolled from the material roll, a guide rail disposed horizontally above the support shelf, the rail slideably receiving a utility knife pocket removably holding a utility knife for sliding across and cutting the bag material to a desired length.

8 Claims, 3 Drawing Sheets

TRASH BAG DISPENSER

BACKGROUND OF THE INVENTION

Rolls of trash bag materials are provided for use in disposing of trash and for use in trash compactors. Bag material is typically cut to the desired length and then bound on each end. Bags are then disposed of as chosen. By providing bag materials in rolls, those cutting the bag length can best choose that length in order to both prevent waste and to fit trash bags into compactors and containers. To date, a convenient form of bag roll holder has not been provided, and more especially not one which offers a ready means for cutting the bags to the desired length. What is needed is a device that fills these needs and is at the same time portable. The present invention fulfills these needs.

FIELD OF THE INVENTION

The invention relates to trash bags and specifically to a trash bag holder and dispenser with selective bag cutting capabilities.

SUMMARY OF THE INVENTION

The general purpose of the trash bag dispenser, described subsequently in greater detail, is to provide a trash bag dispenser which has many novel features that result in an improved trash bag dispenser which is not anticipated, rendered obvious, suggested, or even implied by prior art, either alone or in combination thereof.

To accomplish this, the invention comprises a trash bag dispenser for use with a typical roll of trash bag material. The trash bag material is in a flattened tube form. The dispenser comprises a parallelepiped frame having a back, two spaced apart sides, and a bottom. A v-notch in disposed within a top of each side. The v-notch removably receives a support rod holding a roll of the trash bag material. A horizontal support shelf is disposed below the v-notches, the shelf for supporting material unrolled from the trash bag material roll. A guide rail is disposed horizontally above the support shelf. The guide rail slideably receives a utility knife pocket removably holding a utility knife. The guide rail further comprises a blade cutout such that the utility knife blade extends below the guide rail. The blade slides across with the knife pocket. The blade slides above the support shelf. The trash bag material is pulled outward off of the roll and above the support shelf. The blade is slid across to cut the trash bag material to the desired length. A storage compartment is disposed on in inside surface of one side of the invention. The storage compartment is used to hold trash bag ties and other supplies. The ends of the cut material are thereby tied off to form a bag as needed. Typically, one end of the cut bag material is tied off, the bag then filled with trash, and the other end of the bag tied off.

The invention if offered in various sizes to accommodate both large and small rolls of trash bag materials. The invention is offered with casters for mobility sake. One example of the invention features two casters on the back of the bottom. Two locking casters are provided on the front of the bottom, whereby the invention can be more steadily placed as needed. Examples of the invention are offered in wood, plastic, metal, and other appropriate materials. The invention removably receives a typical utility knife with interchangeable blades.

Thus has been broadly outlined the more important features of the trash bag dispenser so that the detailed description thereof that follows may be better understood and in order that the present contribution to the art may be better appreciated.

Numerous objects, features and advantages of the trash bag dispenser will be readily apparent to those of ordinary skill in the art upon reading the following detailed description of presently preferred, but nonetheless illustrative, examples of the trash bag dispenser when taken in conjunction with the accompanying drawings.

In this respect, before explaining the current examples of the trash bag dispenser in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the trash bag dispenser. It is therefore important that the claims be regarded as including such equivalent constructions insofar as they do not depart from the spirit and scope of the present invention.

Objects of the trash bag dispenser, along with various novel features that characterize the invention are particularly pointed out in the claims forming a part of this disclosure. For better understanding of the trash bag dispenser, its operating advantages and specific objects attained by its uses, refer to the accompanying drawings and description.

DETAILED DESCRIPTION OF THE DRAWINGS

With reference now to the drawings, and in particular FIGS. 1 through 4 thereof, example of the trash bag dispenser employing the principles and concepts of the present invention and generally designated by the reference number 10 will be described.

Figure 1:
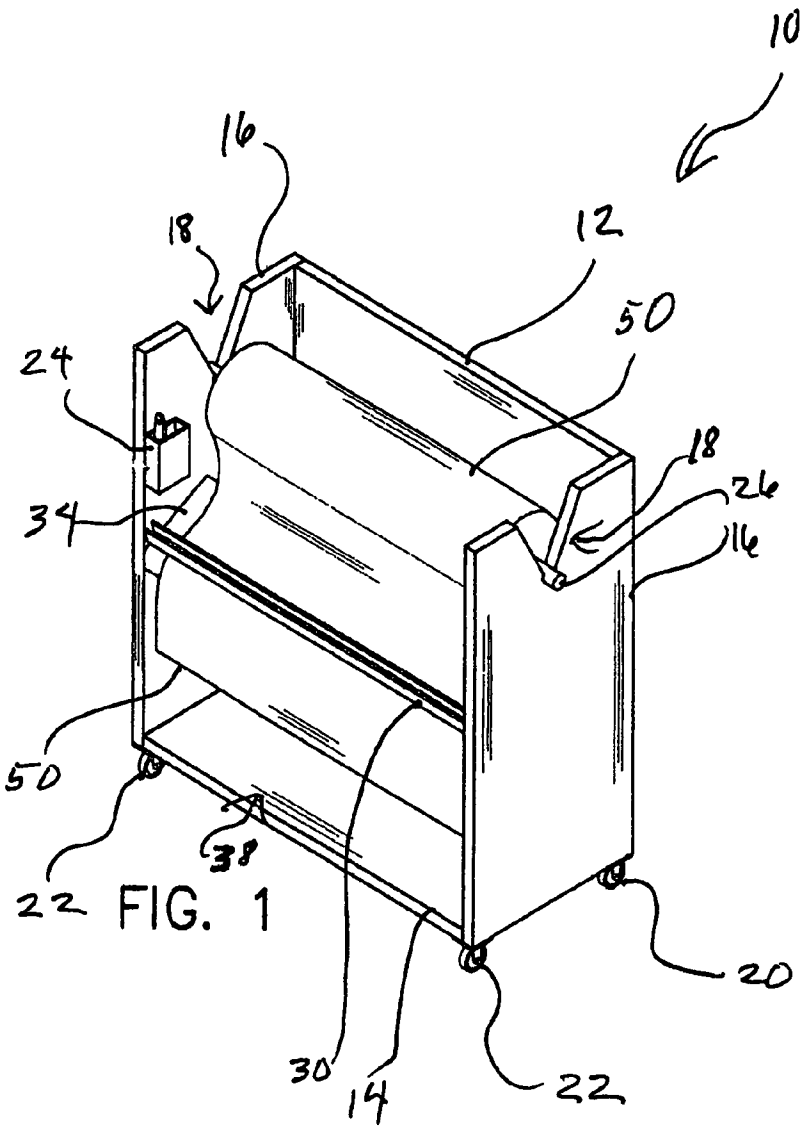
FIG. 1 is a perspective view of the invention with a typical trash bag material roll held by the support rod within the invention.

Referring to FIG. 1, the invention 10 comprises a parallelepiped frame having a back 12, two spaced apart sides 16, and a bottom 14. A v-notch 18 is disposed in a top of each side 16. The support rod 26 is removably fitted within the v-notches 18. The support rod 26 removably holds the roll of trash bag material 50. The horizontal support shelf 34 is disposed below the v-notches 18 and toward the front of the invention 10. The support shelf 34 supports trash bag material 50 unrolled from the bag material 50 roll. The support shelf 34 is affixed to the inside of the sides of the invention 10. The support shelf 34 is slanted such that the support shelf 34 is highest toward the back of the invention 10. The guide rail 30 is disposed horizontally above the support shelf 34. The guide rail 30 slideably holds the knife pocket 36 above the guide rail 30. The knife pocket 36 removably holds the utility knife 40. The utility knife 40 is well known in the art. Therefore, the bag material 50 is pulled off of the roll and across and above the support shelf 34. The utility knife 40 is slid horizontally across the bag material 50 to cut the material 50 to a desired length. The storage compartment 24 is affixed to the inside of the side 16 of the invention 10. The storage compartment 24 provides for holding bag ties (not shown) and the like. A storage area 38 is provided below the support shelf 34 within the invention 10. Two spaced apart omni-directional rear casters 20 are provided on the outside bottom 14 surface toward the back of the invention 10. Two spaced apart locking casters 22 are provided on the bottom 14 surface toward the front of the invention 10.

Figure 2:
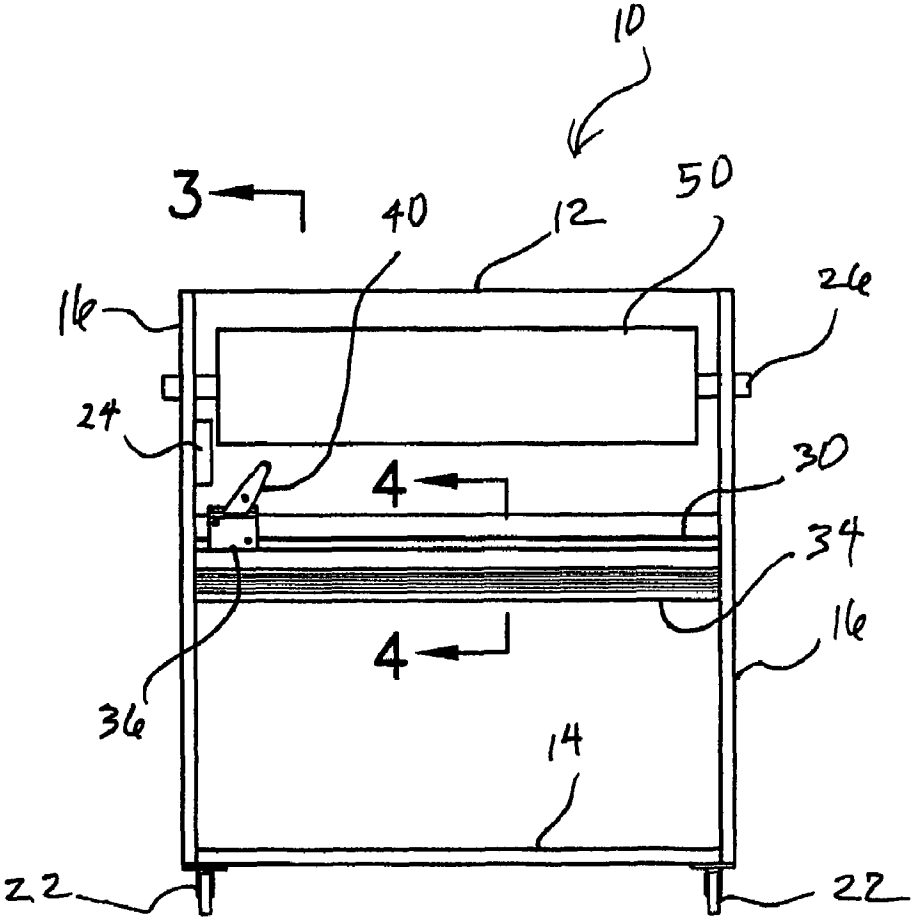
FIG. 2 is a front elevation view of the invention with the trash bag roll removably held within.

Referring to FIG. 2, the utility knife 40 is held at a slant to the bag material 50 by the knife pocket 36. The knife pocket 36 slides across the guide rail 30. The omni-directional locking casters 22 are facing forward.

Figure 3:
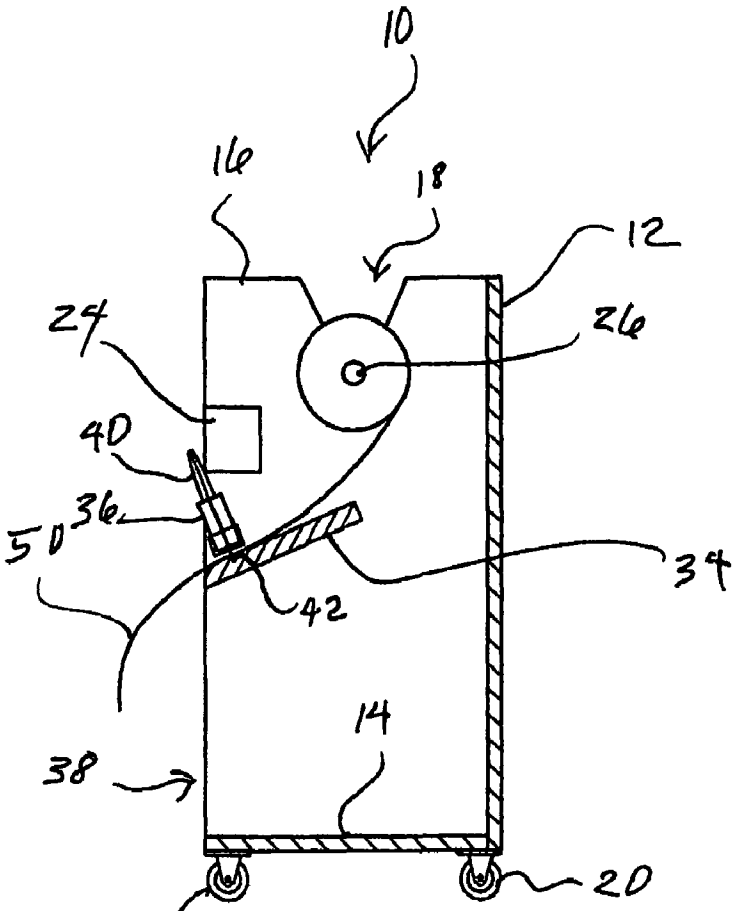
FIG. 3 is a cross sectional view of FIG. 2, taken along the line 3-3.

Referring to FIG. 3, the utility knife 40 with blade 42 is held perpendicular to the bag material 50. The v-notches 18 provide for easy removal of the support rod 26 and therefore the bag material 50. The storage area 38 provides for storage of any desired materials.

Figure 4:
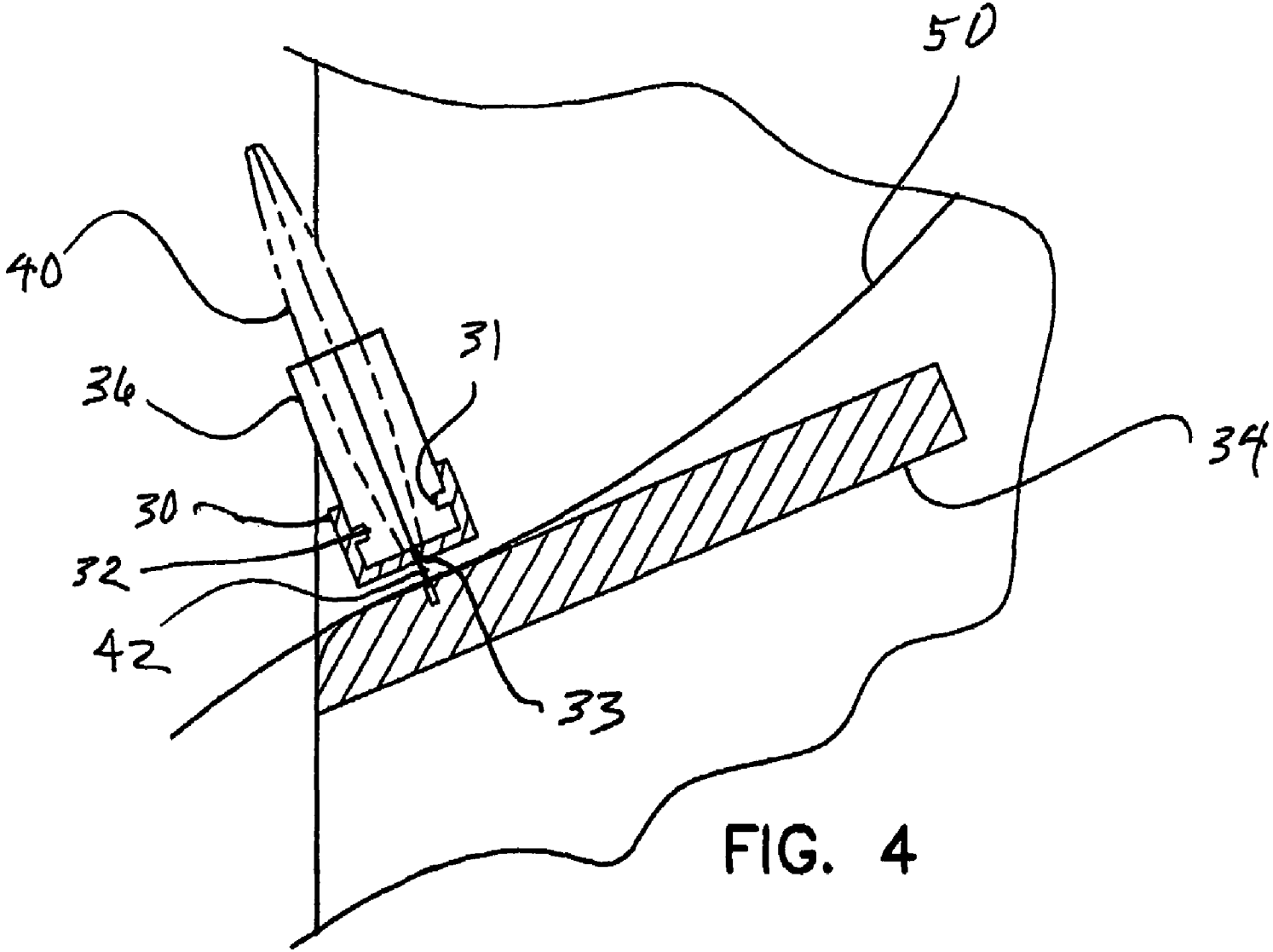
FIG. 4 is a cross sectional view of FIG. 2, the view of the knife pocket removably and slideably holding the utility knife blade above the support shelf, the view taken along the line 4-4.

Referring to FIG. 4, the utility knife 40 is removably held within the knife pocket 36. The horizontal support shelf 34 is slanted. The support shelf 34 supports trash bag material 50 unrolled from the material 50 roll. The guide rail 30 is disposed horizontally above the support shelf 34. Two opposed guide rail detents 31 are disposed in opposite sides of the guide rail 30. The knife pocket 36 slideably fits within the guide rail 30. The knife pocket 36 removably holds the utility knife 40. A pair of opposed notches 32 are disposed within the knife pocket 36. The notches 32 slideably receive the guide rail detents 31, whereby the knife pocket 36 is guided across the guide rail 30. The blade cutout 33 is disposed within the bottom of the guide rail 30, whereby the utility knife blade 42 projects below the guide rail 30 and toward the support shelf 34. The blade 42 does not contact the support shelf 34. The material 50 is pulled and held above the support shelf 34.

With respect to the above description then, it is to be realized that the optimum dimensional relationships for the parts of the trash bag dispenser, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A trash bag dispenser for dispensing a roll of trash bag material, the dispenser comprising:

a parallelepiped frame having a back, two spaced apart opposing sides, and a bottom;

a v-notch in a top of each opposing side;

a support rod removably fitted within the v-notches, the support rod for holding the roll of trash bag material;

a horizontal support shelf disposed below the v-notches, the support shelf for supporting trash bag material unrolled from the material roll;

a guide rail disposed horizontally above the support shelf;

means for slideably holding a utility knife above the guide rail;

whereby the bag material is pulled off of the roll and across and above the support shelf, thereby providing for the utility knife to be slid horizontally across the material to cut the material to a desired length;

wherein the support shelf is affixed to the sides of the dispenser;

wherein the support shelf is slanted, the support shelf highest toward the back of the dispenser;

wherein the utility knife is removably held;

wherein a storage area is provided below the support shelf;

wherein a plurality of spaced apart casters are provided on an outside bottom surface of the bottom of the dispenser.

2. The dispenser in claim 1 wherein 4 casters are provided, two casters adjacent to a front of the bottom;

two casters adjacent to a rear of the bottom.

3. The dispenser in claim 2 wherein the two front casters are lockable.

4. The dispenser in claim 3 wherein a storage compartment is provided on an inner surface of an inside of one side of the dispenser.

5. A trash bag dispenser for dispensing a roll of trash bag material, the dispenser comprising:

a parallelepiped frame having a back, two spaced apart opposing sides, and a bottom;

a v-notch in a top of each opposing side;

a support rod removably fitted within the v-notch, the support rod for holding the roll of trash bag material;

a horizontal support shelf disposed below the v-notches, the support shelf for supporting trash bag material unrolled from the material roll;

a guide rail disposed horizontally above the support shelf;

two opposed guide rail detents in opposite sides of the guide rail;

a knife pocket slideably fitted within the guide rail, the knife pocket for removably holding a utility knife;

a pair of opposed notches within the knife pocket, the notches slideably received by the guide rail detents, whereby the knife pocket is guided across the guide rail;

a blade cutout within a bottom of the guide rail, whereby the utility knife blade projects below the guide rail and toward the support shelf;

whereby the bag material is pulled off of the roll and across and above the support shelf, thereby providing for the utility knife to be slid horizontally across the material to cut the material to a desired length;

wherein the support shelf is affixed to the sides of the dispenser;

wherein the support shelf is slanted, the support shelf highest toward the back of the dispenser;

wherein the utility knife is removably held;

wherein a storage area is provided below the support shelf;

wherein a plurality of spaced apart casters are provided on an outside bottom surface of the bottom of the dispenser.

6. The dispenser in claim 5 wherein 4 casters are provided, two casters adjacent to a front of the bottom;

two casters adjacent to a rear of the bottom.

7. The dispenser in claim 6 wherein the two front casters are lockable.

8. The dispenser in claim 7 wherein a storage compartment is provided on an inner surface of an inside of one side of the dispenser.

* * * * *